US006557565B1

(12) United States Patent
McLin

(10) Patent No.: US 6,557,565 B1
(45) Date of Patent: May 6, 2003

(54) IN-SITU WELL CLEANING AND REFURBISHING DEVICE

(75) Inventor: Stephen G. McLin, Los Alamos, NM (US)

(73) Assignee: The Regents of the University of California, Los Alamos, NM (US)

( * ) Notice: Subject to any disclaimer, the term of this patent is extended or adjusted under 35 U.S.C. 154(b) by 221 days.

(21) Appl. No.: 09/676,180

(22) Filed: Sep. 29, 2000

(51) Int. Cl.[7] ..... B08B 9/02; E21B 37/00

(52) U.S. Cl. ..... 134/22.11; 134/22.12; 166/312; 166/173

(58) Field of Search ..... 134/22.11, 22.12, 134/22.13, 22.14, 22.18; 166/170, 173, 223, 242.3, 311, 312

(56) References Cited

U.S. PATENT DOCUMENTS 3,899,027 A * 8/1975 Jenkins ..... 166/249
4,096,869 A * 6/1978 Lawson ..... 134/2
4,830,111 A * 5/1989 Jenkins et al. ..... 166/249
5,865,249 A * 2/1999 Gipson et al. ..... 166/222
6,220,356 B1 * 4/2001 Spikes ..... 166/162
6,315,046 B1 * 11/2001 Jack et al. ..... 166/312

* cited by examiner

*Primary Examiner*—Randy Gulakowski
*Assistant Examiner*—Saeed Chaudhry
(74) *Attorney, Agent, or Firm*—Milton D. Wyrick

(57) ABSTRACT

In order to simplify the cleaning and disinfection of water wells, perforated casings are installed outside and adjacent to a water well casing and screen. This installation provides cleaning and disinfection capability of the well without removing the well's pump. The number of adjacent perforated casings can range from one for a small diameter well to three or more for lager diameter wells. The perforated casings define alternating blank sections and perforated sections.

12 Claims, 4 Drawing Sheets

IN-SITU WELL CLEANING AND REFURBISHING DEVICE

The present invention generally relates to earthen wells, and, more particularly to the cleaning and refurbishing of water wells. This invention was made with government support under Contract No. W-7405-ENG-36 awarded by the U.S. Department of Energy. The Government has certain rights in the invention.

BACKGROUND OF THE INVENTION

All earthen wells, over time, whether oil or water wells, become degraded, usually in a manner that severely decreases a well's production rate. This degradation typically results from clogging of the well's perforated casing and gravel (filter) pack. This clogging is the result of naturally occurring chemical precipitates, such as calcium carbonate or silica, and gelatinous masses produced by iron-secreting bacteria, or other toxic and non-toxic anaerobic bacteria that are in the groundwater. These clogging deposits restrict the oil or water from entering the perforated casing, significantly reducing well performance, and increasing corrosion and encrustation of the casing and screens.

Previous attempts to solve these clogging problems have been difficult and expensive. In most cases, removal of the well's pump is required to allow complete access into the well. After the removal of the pump, the well can be treated using appropriate chemical and mechanical techniques. However, even these measures do not assure success, and often it is necessary to drill a completely new well. In any event, these measures are costly and difficult, and the use of chemicals and mechanical cleaning devices can easily result in damage to well casing and screen sections. The cost of pump removal alone can easily run into tens of thousands dollars.

Surprisingly little effort has been devoted to investigating the benefits of well maintenance programs. The use of appropriate well maintenance programs would improve well performance and extend well life. This neglect is probably due to additional program costs, and the fact that changes in this industry are not easily effected.

In the past, some water wells had small-diameter metal pipes welded to the outside of the casing. These small diameter pipes normally extended only to the top of the well screen and to below the location of the well pump. Pressure transducers or measuring tapes could be inserted into these pipes to monitor changes in water levels without interfering with the pump. However, these pipes provided no means for cleaning the well.

The present invention solves many repair problems associated with clogged water wells. The invention allows easy and complete access to the exterior of the well casing, screen, and gravel pack where clogging originates. Over time, regular scheduled use of the invention can significantly improve well performance and reduce pumping costs. Current repair efforts are inefficient because they require first that the well pump be removed, and second that the interior of the well screen be cleaned. Both of these functions are laborious and time consuming.

It is therefore an object of the present invention to provide apparatus and method for the clearing of clogs from water wells.

It is another object of the present invention to provide apparatus and method capable of cleaning and disinfecting wells.

It is another object of the present invention to provide apparatus allowing direct access to the exterior surfaces of the gravel pack, well screen, and casing of a water well so that they can be efficiently cleaned and disinfected.

It is a feature of the present invention that well pumps and other surface equipment do not need to be removed from the well in order for cleaning and disinfecting of the well to be accomplished.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention comprises least one perforated casing situated adjacent to an outside surface of a water well casing having a top and a bottom, the at least one perforated casing extending from a first position at the top of the water well casing to a second position at the bottom of the water well casing. 3. In another aspect of the present invention, and in accordance with its purposes, a method of cleaning a water well comprises the steps of installing at least one perforated casing adjacent to an outer surface of a water well casing having a top and a bottom, the at least one perforated casing extending from the top of the water well casing to the bottom of the water well casing, and forcing appropriate chemicals and surfactants through the at least one perforated casing to clean the water well.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

The present invention provides an apparatus and method for the cleaning and disinfecting, where appropriate, of water wells. The invention can be understood most easily through reference to the drawings.

Figure 1:
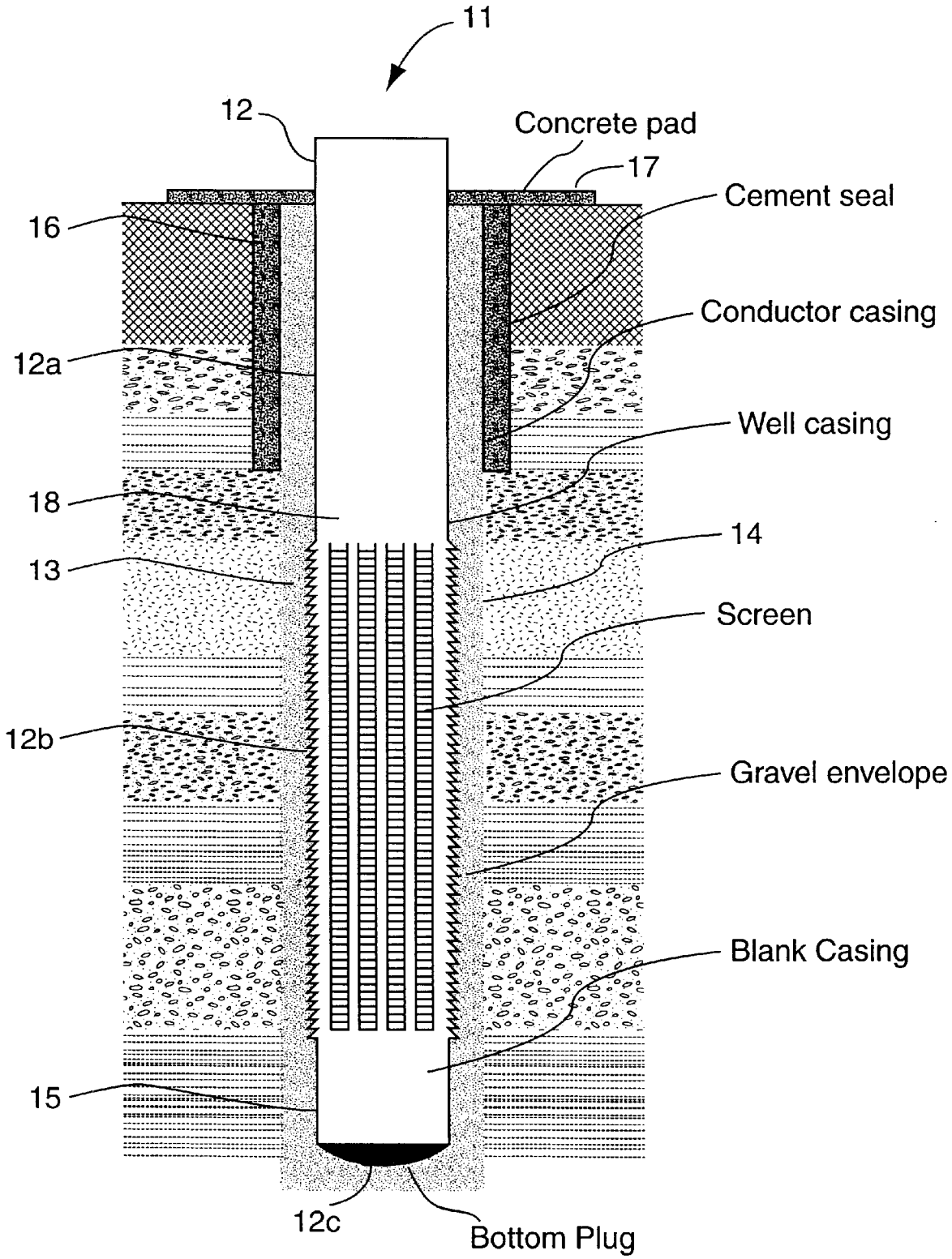
FIG. 1 is cross-sectional view of a typical water well.

Referring to FIG. 1, there can be seen a typical water well 11 in which casing 12 has been inserted, shown as both a side view and top view. Casing 12 includes blank section 12*a*, perforated section 12*b* along an appropriate length of the middle portion of its length, and blank casing 15 and bottom plug 12*c*. Casing 12 is surrounded by gravel pack 13, and is situated in borehole 14. Cement seal 16 and concrete pad 17 surround the upper portion of casing 12 in the area of casing 12 where the well's pump and associated housing (not shown) are located. A protective conductor casing 18 is often located in the upper portions of the casing 12 to prevent hydraulic communication between shallow and deep geological units through the wellbore annulus.

In operation, ground water flows through gravel pack 13, and through perforated section 12*b* in casing 12, and collects in casing 12. A pump located in the upper portion of casing 12 (not shown) then pumps the collected water to the surface.

Over time, gravel pack 13 and outside portions of perforated section 12*b* become clogged with naturally occurring chemical precipitates, such as calcium carbonate or silica, and residue from iron-secreting bacteria, or other toxic and nontoxic anaerobic bacteria that are introduced while drilling the well, or may be naturally occurring. These clogging deposits restrict ground water from entering casing 12, significantly reducing well production and increasing corrosion on the inside portions of perforated sections 12*b*.

Figure 2:
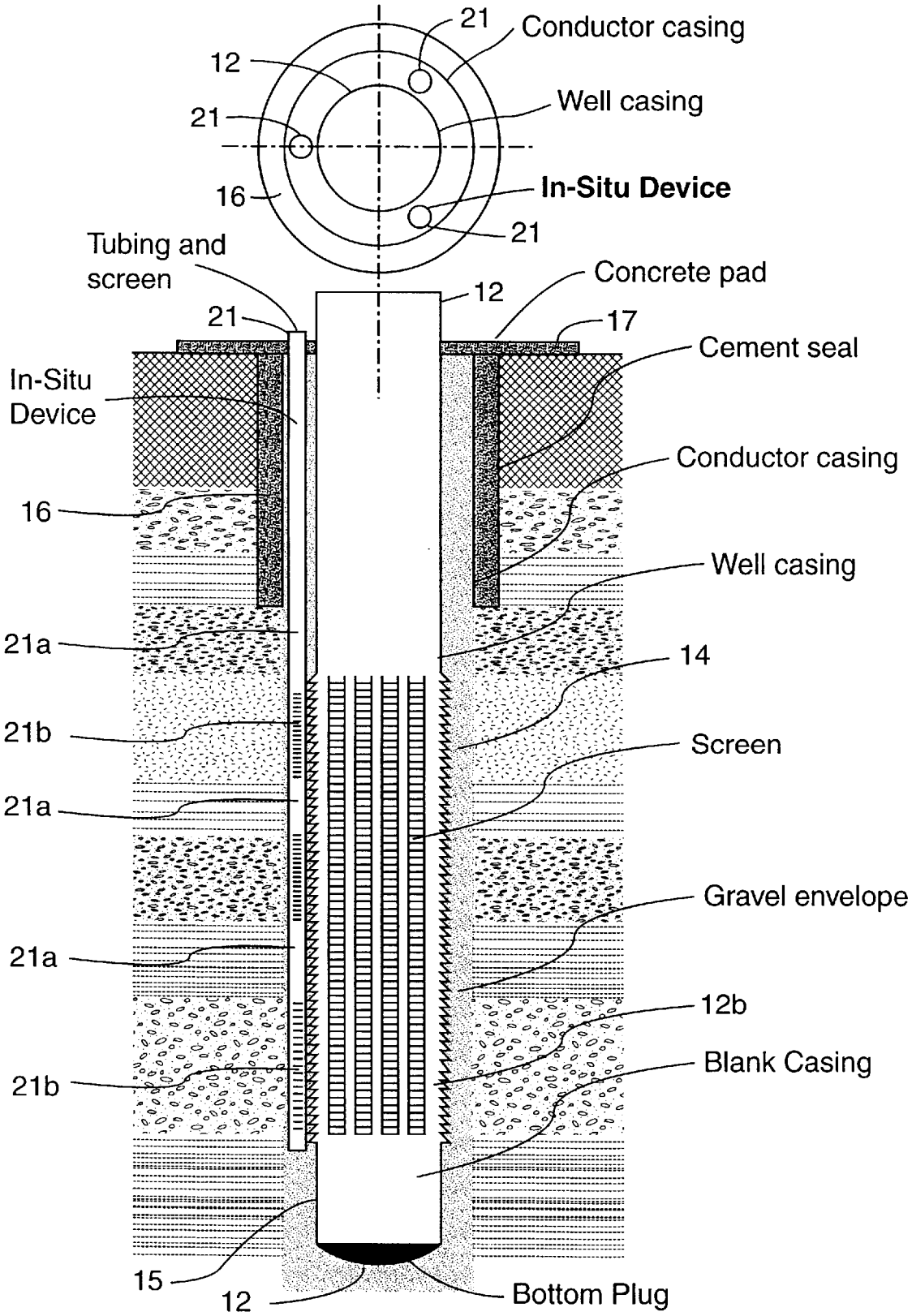
FIG. 2 is a cross-sectional and top view of a typical water well with the cleaning device according to the present invention in place.

As seen in FIG. 2, elements of the present invention can be seen in a typical water well installation, shown in both side and top views. The water well disinfecting and refurbishing apparatus of the present invention includes a small casing 21, whose diameter can range between approximately 1.0 to 4.0 inches. The device can easily fit into borehole 14 at any desired location around the outside circumference of the well casing 12. A normal configuration would include between one (1) and three (3) small casings 21, although more could be employed based on a particular well diameter. As shown in FIG. 2, small casing 21 alternates between blank sections 21*a* and perforated sections 21*b*. Small casing 21 extends from the surface to lower end of perforated section 12*b*.

Figure 3:
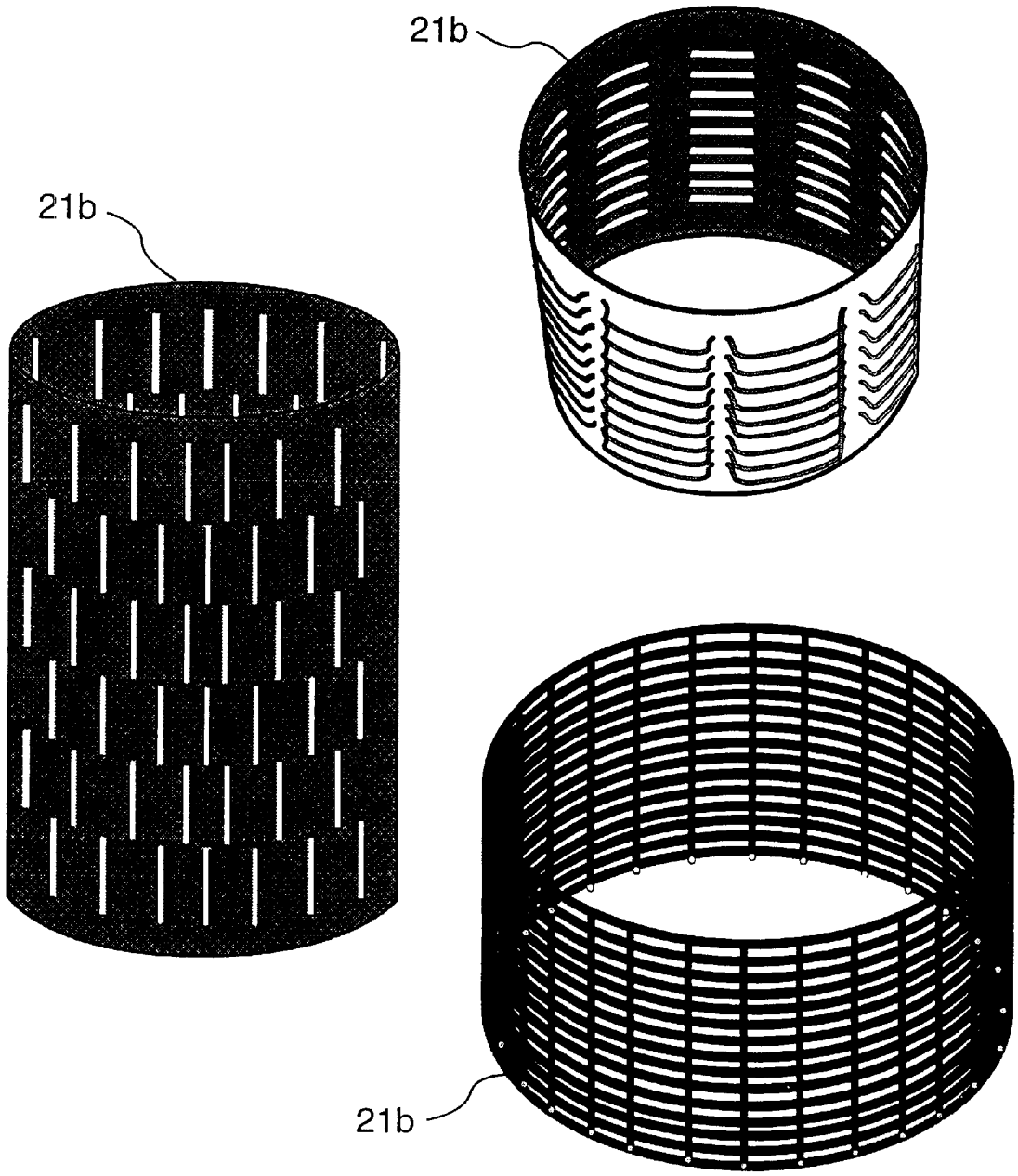
FIG. 3 contains pictorial views of various configurations for perforated sections according to the present invention.

FIG. 3 illustrates the construction of typical perforated sections 21*b*, depicting various possible perforations. As seen, perforated section 21*b* is cylindrical with a diameter of approximately 1.0 to 4.0 inches. It has openings, several configurations of which are illustrated, that allow liquids, but not gravel, to pass through. The openings in perforated section 21*b* allow cleansing and disinfecting solutions to be pumped through the top blank section 21*a* of small casing 21 (FIG. 2). The cleansing and disinfecting solutions include such substances as commercially available disinfectants, acids, surfactants, or any other appropriate chemicals.

It may become necessary in certain situations to concentrate the flow of cleansing agents or disinfectants through a particular arrangement of one or more perforated sections 21*b*. To accomplish this with the present invention, it only is necessary to insert a length of blank casing, having an outside diameter just slightly smaller than the inside diameter of small casing 21, into small casing 21 to cover the perforations desired. This will increase the flow through uncovered perforations of selected perforated sections 21*b*.

Figure 4:
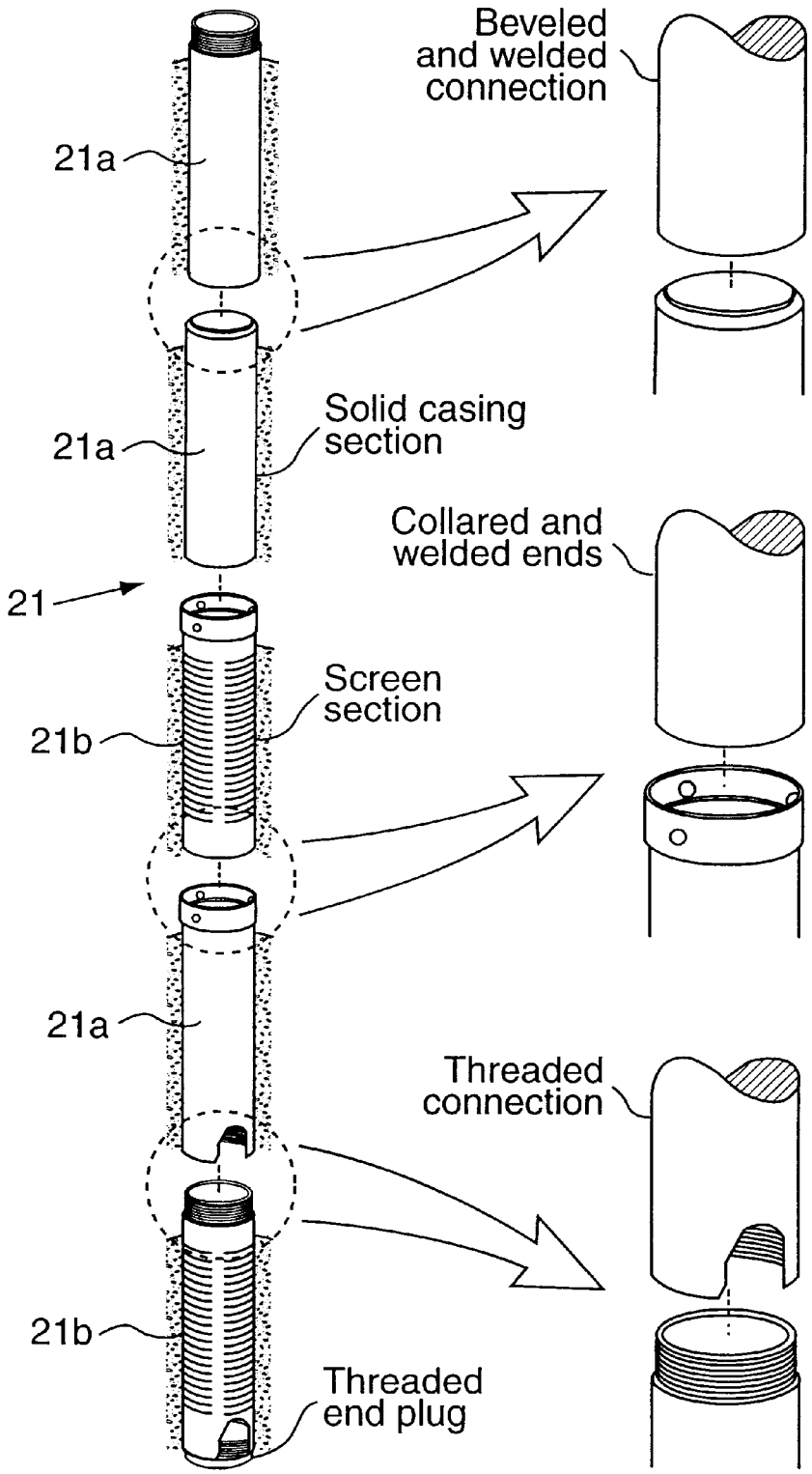
FIG. 4 contains an illustration of one arrangement of blank sections and perforated sections according to the present invention as well as some methods of connecting adjoining sections.

In FIG. 4, a typical configuration of small casing 21 is illustrated with several means of connection between blank sections 21*a* and perforated sections 21*b*. As shown, the blank section 21*a* at the surface could be threaded or have any other appropriate connection for connecting to cleaning solutions. As sections of small casing 21 are supplied in 10 to 40 foot lengths, an appropriate number of blank sections 21*a* could be used before reaching perforated section 12*b* of casing 12 (FIG. 2), depending on the depth of the water well.

Individual sections can be connected in various ways according to the material from which small casing 21 is made. If small casing 21 is metallic, sections could be connected using beveled ends and welding, collared ends and welding, or threaded ends. If made of plastic, sections could have threaded ends or be coupled with connectors and adhesive. Blanks sections 21*a* and perforated sections 21*b* can be arranged in any appropriate manner down the length of small casing 21. Small casing 21 is sealed with end plug 21*c*. Alternative materials that may be used for sections of small casing 21 include mild carbon and stainless steels, reinforced fiberglass epoxy, plastics, or other materials commonly used in oil and water wells.

Small casing 21 can be any appropriate casing having the characteristics delineated herein. One such casing that can be used with the present invention is manufactured by UOP® under the mark of JOHNSON® SCREENS. UOP® is located at P.O. Box 43118, St. Paul, Minn. 55164-3118.

Referring back to FIG. 2, appropriate cleansing and disinfecting solutions easily can be introduced directly into the gravel pack 13 of water well 11 by pumping the solutions into small casing 21. These fluids flow down small casing 21, and exit through perforated sections 21*b* into gravel pack 13. This route must be followed because of small casing 21 being sealed by end plug 21*c* (FIG. 4*a*). Once in gravel pack 13, the solutions will act to clean and disinfect water well 11. There is no need to remove either surface or downhole equipment to clean the well. In large diameter wells, multiple small casings 21 are installed to insure that the water well 11 will be thoroughly cleaned. The introduction and circulation of chemical cleaners into the small casing 21 and then into the water well 11 can also be improved by using a standard well swab designed to fit the small diameter casing 21.

Small casing 21 is most easily installed at the time of well drilling since it can be put into place during installation of the well casing. However, the present invention can also be used with existing wells. In this event, the pump assembly must be removed to allow placing small casings 21 inside the well casing 11, and then reinstalling the well pump.

The present invention allows many functions to be performed on water well 11 that have previously been either impossible or very difficult and expensive. Some wells have had small-diameter metal pipes welded to the sides of casing that extend downward to the top of the well screen. These pipes provide transducer access to the top of the screen for water level monitoring. However, these pipes do not allow for well cleaning because they do not extend the full extent of the screen and gravel pack.

Well maintenance without the need to remove the well pump is allowed by the present invention. This means that time, labor, and money are saved. Hence, routine well cleaning and maintenance are more likely to be completed. Thus, higher production levels can be maintained for much longer periods of time compared to wells with no maintenance.

The fact that wells build up clogging layers of material is alleviated by the present invention, since all of the clogging substances are treatable by chemicals and surfactants. Should the need arise to restore lost production capacity to a water well, one need only attach appropriate tubing to small casing 21, and pump chemicals and surfactants into well 11. Well 11 is then surged by alternately turning the pump on and off until the chemicals and surfactants are thoroughly mixed in gravel pack 13 and well screen 12*b*. This procedure is repeated until well's production capacity has been restored. Then the offending substances and chemicals are pumped from well 11, and all wastes are properly disposed of prior to well 11 being returned to normal use.

The ability of the present invention to provide this access to the interior of a water well and gravel pack allows a well operator unprecedented abilities to maintain the well. This maintenance can be performed efficiently and inexpensively through use of the present invention.

Examples of appropriate chemicals and surfactants that are used to clean water wells equipped with the present invention include acids, detergents, chlorine, other antibacterial compounds, and fungicidal compounds. Of course the actual chemicals to be employed will depend on the situation at a particular water well. The benefits of the present invention can be appreciated most easily when one considers the benefits of accomplishing cleaning of a well without having to remove the well's pump.

As the present invention allows efficient access to the entire length of a well's screen and gravel pack, it permits the inexpensive and effective cleaning of water wells. This means that a well's initial performance can be maintained for a longer period of time. It also means that the well will have lower energy costs associated with pumping, and that the well's operational life can be extended.

The present invention will find application in water wells throughout the world. In the United States alone there are approximately 800,000 water wells drilled annually. With the present invention installed in a significant percentage of these new wells, the savings to municipalities and individuals could be great. The present invention can accomplish the effective cleaning of water wells through relatively simple components, assuring meaningful benefits to well operators and owners.

The foregoing description of the preferred embodiments of the invention has been presented for purposes of illustration and description. It is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Water well cleaning apparatus comprising at least one perforated casing situated adjacent to an outer surface of a water well casing having a top and a bottom, said at least one perforated casing extending from a first position at said top of said water well casing to a second position at said bottom of said water well casing.

2. The well cleaning apparatus as described in claim 1, wherein said at least one perforated casing comprises two perforated casings.

3. The well cleaning apparatus as described in claim 1, wherein said at least one perforated casing comprises three perforated casings.

4. The well cleaning apparatus as described in claim 1, wherein said at least one perforated casing comprises a casing having alternating areas of perforated casing and blank casing and defines a diameter in the range from 1.0 inch to 4.0 inch.

5. The well cleaning apparatus as described in claim 1, further comprising a blank tube inserted inside said at least one perforated casing to cover predetermined areas of said at least one perforated casing.

6. Water well cleaning apparatus for an existing water well comprising at least one perforated casing situated adjacent to an inner surface of a water well casing having a top land a bottom, said at least one perforated casing extending from a first position at said top of said water well casing to a second position at said bottom of said water well casing;

wherein cleaners and surfactants will be injected into said at least one perforated casing flow out of said at least one perforated casing to clean said water well.

7. The well cleaning apparatus as described in claim 6, wherein said at least one perforated casing comprises two perforated casings.

8. The well cleaning apparatus as described in claim 6, wherein said at least one perforated casing comprises three perforated casings.

9. The well cleaning apparatus as described in claim 6, wherein said at least one perforated casing comprises a casing having alternating areas of perforated casing and blank casing and defines a diameter in the range from 1.0 inch to 4.0 inches.

10. A method of cleaning a water well having a pump comprising the steps of:

installing at least one perforated casing adjacent to an outer surface of a water well casing having a top and a bottom, said at least one perforated casing extending from said top of said water well casing to said bottom of said water well casing;

forcing appropriate chemicals and surfactants through said at least one perforated casing to clean said water well.

11. The method as described in claim 10, wherein said step of forcing appropriated chemicals and surfactants comprises using a swab inside said at least one perforated casing to cause said chemicals and surfactants to surge into said well casing.

12. The method described in claim 11, wherein said step of forcing appropriate chemicals and surfactants comprises using said pump to surge said chemicals and surfactants into said casing by alternately turning said pump on and off.

* * * * *